US006079112A

United States Patent [19]

Love

[11] Patent Number: 6,079,112

[45] Date of Patent: Jun. 27, 2000

[54] POWDER CHALK LINE DISPENSER WITH DEMOUNTED CHALK RESERVOIR

[76] Inventor: Brian C. Love, 6335 Goat Hollow Rd., Martinsville, Ind. 46151

[21] Appl. No.: 09/034,414

[22] Filed: Mar. 4, 1998

[51] Int. Cl.[7] ..... B44D 3/38

[52] U.S. Cl. ..... 33/414; 141/367

[58] Field of Search ..... 33/414, 756; 141/367, 141/378; 220/699, 737

[56] References Cited

U.S. PATENT DOCUMENTS

| | | | |
|---|---|---|---|
| 1,208,068 | 12/1916 | Winchell | 33/414 |
| 1,271,470 | 7/1918 | Ibaraki | 33/414 |
| 1,373,884 | 4/1921 | Gregory | 33/414 |
| 1,545,327 | 7/1925 | Hobson | 33/414 |
| 1,868,389 | 7/1932 | Howard | 141/367 |
| 2,245,195 | 6/1941 | Hopkins | 141/367 |
| 3,455,350 | 7/1969 | Hinxlage | 141/367 |
| 3,691,639 | 9/1972 | Roeseler et al. | 33/414 |
| 4,071,163 | 1/1978 | Martin | 220/737 |
| 4,197,656 | 4/1980 | Lane et al. | 33/414 |
| 4,565,011 | 1/1986 | Karger | 33/414 |
| 4,660,291 | 4/1987 | Dehn | 33/414 |
| 4,926,562 | 5/1990 | Hwu | 33/414 |
| 4,947,556 | 8/1990 | Peil | 33/370 |
| 5,444,919 | 8/1995 | Alves | 33/414 |
| 5,493,787 | 2/1996 | Owens | 33/414 |
| 5,562,131 | 10/1996 | Drawbaugh | 141/378 |
| 5,644,852 | 7/1997 | Fuller et al. | 33/414 |
| 5,727,324 | 3/1998 | Moore | 33/414 |

*Primary Examiner*—G. Bradley Bennett
*Attorney, Agent, or Firm*—Barnes & Thornburg

[57] ABSTRACT

A powdered chalk line dispenser comprising a housing formed from at least two mated together cover plates, which define a cavity with an opening and a threaded aperture; a spool assembly is located in said housing cavity; a chalk line is wrapped around said spool and extends outwardly of the housing through the opening in the housing; a spring and manual lever are attached to the spool to cause the spool to rotate in a direction to apply a force to the chalk line to wrap the chalk line around the spool; an aperture in said housing is internally threaded for attachment to an externally threaded chalk supply bottle which supplies chalk into the cavity for coating the chalk line.

19 Claims, 1 Drawing Sheet

POWDER CHALK LINE DISPENSER WITH DEMOUNTED CHALK RESERVOIR

BACKGROUND OF SUMMARY OF INVENTION

This invention relates to a chalk line dispenser with a threaded aperture adapted to be connected to a supply container for chalk.

Chalk line dispensers normally include a hollow housing containing a spool around which is wrapped a chalk line and which spool is driven by a spring and/or mechanical handle for rewinding the chalk line into the housing, through a supply of chalk to cause the chalk line to be coated with chalk as the chalk line is wound around the spool. An example of such a chalk line dispenser can be found in U.S. Pat. No. 5,644,852 (issued Jul. 8, 1997) to Fuller et al., the structure of which is specifically incorporated by reference herein.

In use, the chalk line dispenser is secured on the item to be marked with a straight chalked line and the chalk line is withdrawn outwardly from the dispenser to another point on the article to be marked. The chalk line is then lifted slightly (stretching it) and then released. As the line returns to its unlifted position, it thumps against the article to be marked, which thumping action release chalk from the chalk line and deposits the same on the material in a straight line.

Previous chalk line dispensers suffer from a problem of having a small compartment for the chalk, requiring frequent refilling of chalk.

Previous chalk line dispensers suffer from a problem that the opening for filling of the chalk line dispenser with chalk is of such a size and/or location that spills occur in the refilling operation.

The instant invention is directed to a chalk line dispenser that can be coupled to a refill supply container of chalk.

DETAILED DESCRIPTION OF THE DRAWINGS

Figure 1:
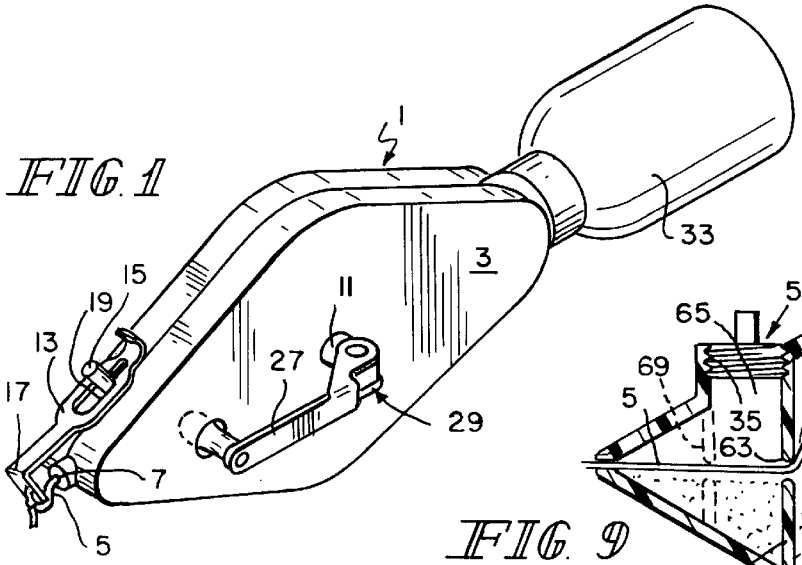
FIG. 1 is a three dimensional representation of a chalk line dispenser attached to a supply container of chalk.
Figure 9:
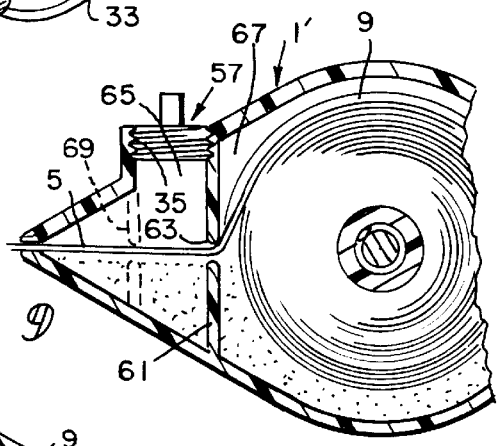
FIG. 9 shows in side cross-section two alternative embodiments for the internal cavity of the chalk line dispenser of FIGS. 1–3.

FIG. 1 shows a chalk line dispenser 1 having a housing 3 defining a hollow cavity 4, a chalk line 5 extending into the housing through an opening 7 provided with a seal (not shown), which chalk line 5 is wrapped about a spool 9 rotatably mounted in the housing 3 via shaft 11. The shaft 11 is biased in a clockwise direction (see the arrow in FIG. 2) by a coil spring 21 attached to the housing 3 at 23 and to the spool 9 at 25, to cause the chalk line 5 to be wound on the spool.

A clip 13 is secured to an end of the chalk line 5 which extends outwardly of the housing 3. The clip 13 keeps the chalk line 5 from withdrawing completely into the housing 3 and is bent at 17 and is provided with a hole 19 to be mounted on a post 15 secured to the housing 3. The bend 17 of the clip and the hole 19 allows the lip to be secured to a piece of material which is to be marked as will be explained later.

In place of, or in addition to, the post 15, a magnet (not shown) could be located on the clip 13 to hold or assist in holding the clip 13 to the housing or to the material to be marked if the material is iron. A magnet (not shown) could be located on the housing 3 if the housing is not iron to attract and hold a magnet on the clip 13, or if the clip 13 is iron, to directly hold the clip to the housing.

A hand crank 27 is pivotally attached to the spool 9 shaft 11 for also rotating the spool 9. The pivot 29 allows the handle to assume the position with hand grip 31 extending outwardly (as shown in solid in FIG. 3) or rotated 180° to a nested position (as shown in dotted configuration in FIG. 3).

Figure 2:
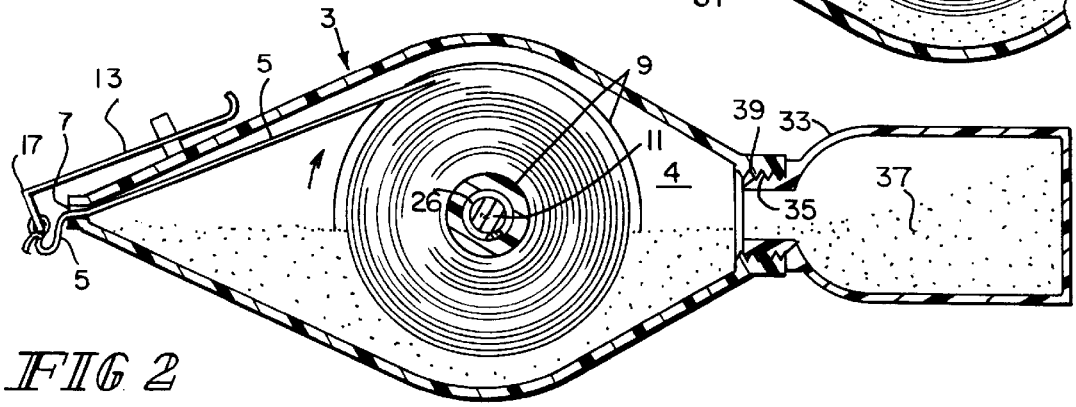
FIG. 2 is a side view in section of the chalk line dispenser and supply container of FIG. 1.
Figure 3:
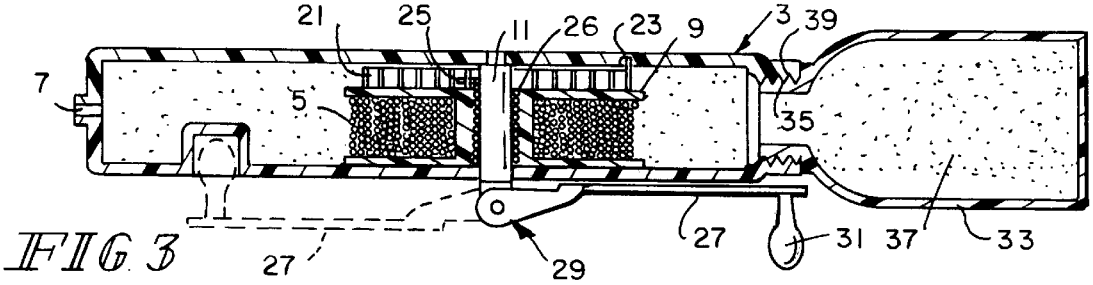
FIG. 3 is a top view in section of the chalk line dispenser and supply container of FIGS. 1 and 2, but with the supply container unscrewed from the chalk line dispenser.
Figure 4:
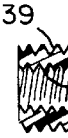
FIGS. 4, 5 and 6 show various adapters for chalk line dispenser of FIGS. 1–3 in cross-section for accommodating supply containers with different threaded outlets from a single sized threaded fill aperture in the dispenser.
Figure 5:
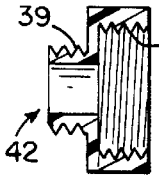
Figure 6:
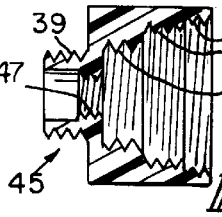
Figure 7:
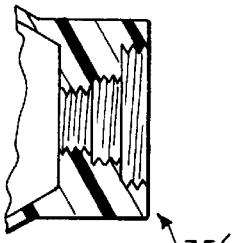
FIG. 7 shows a modified threaded aperture for the chalk line dispenser in cross-section.

A supply bottle 33, containing chalk 37 for the chalk line 7, is mounted to the chalk line dispenser 1 through an internally threaded aperture 35 (as shown in FIG. 1). FIGS. 2 and 3 show the supply bottle separated from the chalk line dispenser 1. The supply bottle has a threaded neck 39 which is closed by a cap (not shown) when sold in hardware stores. The cap is removed and the bottle 33 is directly screwed into the threaded aperture 35. Therefore, the thread size 35 of the aperture should be sized to accommodate the supply bottle 33 threaded neck 39. Since different manufacturers of chalk may use different sized bottles 33 or threaded necks 39, adapters 41, 42 and 45 are provided for accommodating this different size (see FIGS. 4, 5 and 6). FIG. 4 shows an adapter 41 for accommodating smaller bottle necks by internal thread 47. FIG. 5 shows an adapter 42 for accommodating larger bottle necks by internal thread 49. FIG. 6 shows an adapter 45 for accommodating both smaller and larger bottle necks by internal threads 47, 51, 53 and 55. In this adapter 45, the thread 51 could be the same size as the thread 39 so that the adapter could be permanently attached to the chalk line dispenser. Instead of an adapter to accommodate different sized chalk supply bottle necks, the aperture 35 itself might be stopped with multiple thread sizes as shown in FIG. 7.

Figure 8:
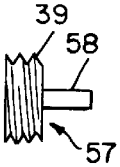
FIG. 8 shows a plug for the threader aperture of the chalk line dispenser in cross-section.

When a supply bottle 33 is not attached to the chalk line dispenser 1, an externally threaded plug 57 (FIG. 8) with twist handle 58 could be inserted into threaded aperture 35. To avoid losing the plug 57, or adapters 41, 42, 45, they could be provided with a magnet (not shown) or be made of iron to be held by a magnet (not shown) on the chalk line dispenser 1, or by an iron insert (not shown) on the chalk line dispenser 1, if the chalk line dispenser 1 is not made from iron.

In use, the chalk supply bottle 33 is attached via threaded aperture 35 to chalk line dispenser 1, which is then rotated 90° (counterclockwise from the FIG. 1 orientation) so that the chalk 37 in the supply bottle flows into the cavity 3 and coats the chalk line 5. The chalk line 5 is then pulled out of the chalk line dispenser 1 by pulling on clip 13 which is secured by its hole 19, bent angle 17 or magnet to the material to be marked. The chalk line dispenser 1 is then moved to another point on the material to be marked while the chalk line 5 is unwound from spool 9 and withdrawn through the chalk 37 in the cavity 4 and out opening 7. The chalk line 5 is held taut by pulling on the chalk line dispenser 1 while holding the handle 27 in place or by placing a finger on the chalk line 5 extending out of the chalk line dispenser 1 adjacent the opening 7. The chalk line 5 is then lifted (stretched) and released, allowing the chalk line 5 to thump against the material to be marked. Thumping of the chalk line 5 causes some of the coated chalk 37 thereon to be deposited in a straight line on the material to be marked.

The FIGS. 1–3 embodiment show the chalk line dispenser cavity 4 to encompass the whole interior of the chalk line dispenser 1. The FIG. 7 embodiment shows a modification where the threaded aperture 35 is located to the left of spool and separated therefrom by a partition 61 with a passageway 63 therethrough for the passage of the chalk line 5. The passageway 63 should also be provided with a seal (not shown). In this embodiment, the chalk 37 is isolated from the spool 9 and spring 21 to keep chalk contamination away from the spool 9 and spring 21. This partition 61 provides for the cavity 4 to be separated into two smaller internal chambers 65, 67. A second partition 69 (shown in dotted lines) could also be provided to create even a smaller chalk 37 containing chamber 65. The smaller chamber is not detrimental, since the supply bottle 33 size still determines how often the chalk line dispenser 1 need be refilled. The small chamber does allow the chalk line 5 to be coated even when the supply of chalk 37 is low.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A powdered chalk line dispenser comprising:

a housing formed by at least two mated together cover plates defining a cavity with an opening and a threaded aperture therebetween;

a spool assembly located in said housing cavity;

a chalk line wrapped around said spool and having an end extending outwardly of the housing through the opening in the housing;

a winding assembly attached to the spool to cause the spool to rotate in a direction to apply a force to the chalk line to wrap the chalk line around the spool; and the aperture in said housing being internally threaded and provided with a plurality of different sized threads for attachment to an externally threaded chalk supply bottle; and wherein the different sizes of the aperture threads are such as to directly accept different sized threads found on the neck of chalk supply bottles.

2. The dispenser of claim 1 having the threaded aperture provided with at least two sets of threads, one set of said at least two sets of threads being internal threads being sized to directly accept threads on a chalk supply bottle.

3. The dispenser of claim 2 wherein the chalk line dispenser is provided with at least two sets of internal threads of different diameters for direct acceptance of threads of differently sized threaded necks of chalk supply bottles.

4. The dispenser of claim 1 wherein the cavity has at least one partition located between the outlet and the spool assembly to divide the cavity into at least two chambers to provide a chamber for the spool and to separate the opening from the spool chamber and wherein the chalk line passes through a hole in the at least one partition.

5. The dispenser of claim 1 wherein the plurality of different sized threads is located on a removable insert that is threaded to the internal threads of the aperture.

6. The dispenser of claim 2 wherein the cavity has at least one partition located between the outlet and the spool assembly to divide the cavity into at least two chambers to provide a chamber for the spool and to separate the opening from the spool chamber and wherein the chalk line passes through a hole in the at least one partition.

7. The dispenser of claim 3 wherein the cavity has at least one partition located between the outlet and the spool assembly to divide the cavity into at least two chambers to provide a chamber for the spool and to separate the opening from the spool chamber and wherein the chalk line passes through a hole in the at least one partition.

8. The dispenser of claim 4 wherein the aperture is located to be in communication with one of the at least two chambers that does not contain the spool assembly.

9. The dispenser of claim 5 wherein the aperture is located to be in communication with one of the at least two chambers that does not contain the spool assembly.

10. The dispenser of claim 6 wherein the aperture is located to be in communication with one of the at least two chambers that does not contain the spool assembly.

11. The dispenser of claim 7 wherein the aperture is located to be in communication with one of the at least two chambers that does not contain the spool assembly.

12. The dispenser of claim 1 wherein the winding assembly is a crank handle located on the outside of the dispenser and connected to rotate with the spool assembly.

13. The dispenser of claim 5 wherein the winding assembly is a crank handle located on the outside of the dispenser and connected to rotate with the spool assembly.

14. The dispenser of claim 2 wherein the winding assembly is a crank handle located on the outside of the dispenser and connected to rotate with the spool assembly.

15. The dispenser of claim 3 wherein the winding assembly is a crank handle located on the outside of the dispenser and connected to rotate with the spool assembly.

16. The dispenser of claim 1 wherein the winding assembly is a coil spring located in the cavity and having one end secured to at least one of the cover plates and another secured end to the spool assembly.

17. The dispenser of claim 5 wherein the winding assembly is a coil spring located in the cavity and having one end secured to at least one of the cover plates and another secured end to the spool assembly.

18. The dispenser of claim 2 wherein the winding assembly is a coil spring located in the cavity and having one end secured to at least one of the cover plates and another secured end to the spool assembly.

19. The dispenser of claim 3 wherein the winding assembly is a coil spring located in the cavity and having one end secured to at least one of the cover plates and another secured end to the spool assembly.

* * * * *